US005331386A

United States Patent [19]

Mizubata et al.

[11] Patent Number: 5,331,386

[45] Date of Patent: Jul. 19, 1994

[54] RECORDING SHEET CONVEYANCE DEVICE FOR USE WITH AN IMAGE FORMING APPARATUS

[75] Inventors: Tsuyoshi Mizubata; Susumu Okui; Yasushi Yamada; Mitsuru Nagoshi, all of Hachioji, Japan

[73] Assignee: Konica Corporation, Tokyo, Japan

[21] Appl. No.: 927,127

[22] Filed: Aug. 7, 1992

[30] Foreign Application Priority Data

Aug. 16, 1991 [JP] Japan ..... 3-205964

[51] Int. Cl.[5] ..... G03G 21/00

[52] U.S. Cl. ..... 355/319; 271/3.1; 271/291; 355/311

[58] Field of Search ..... 355/311, 313, 318, 319; 271/3.1, 291, 296

[56] References Cited

U.S. PATENT DOCUMENTS

| | | | |
|---|---|---|---|
| 4,652,110 | 3/1987 | Sato et al. | 355/315 |
| 4,660,963 | 4/1987 | Stemmle | 355/319 X |
| 4,745,439 | 5/1988 | Hanada et al. | 355/319 X |
| 4,853,740 | 8/1989 | Ushio et al. | 355/319 |
| 5,155,540 | 10/1992 | Yamada et al. | 355/319 |

FOREIGN PATENT DOCUMENTS

| | | |
|---|---|---|
| 58-111955 | 7/1983 | Japan . |
| 59-82247 | 5/1984 | Japan . |
| 59-114227 | 7/1984 | Japan . |
| 62-183471 | 8/1987 | Japan . |

*Primary Examiner*—Fred L. Braun

*Attorney, Agent, or Firm*—Frishauf, Holtz, Goodman & Woodward

[57] ABSTRACT

A sheet conveyer for conveying a sheet so that an image of a document is duplicated on both sides of the sheet by an image forming machine such as a photocopy machine. The sheet conveyer has; a first conveyance path for conveying the sheet to an image forming section of the image forming machine; a second conveyance path for conveying the sheet from the image forming section to a tray; the tray for holding the sheet; a third conveyance path for conveying the sheet from the tray to the image forming section; and, a pair of nip rollers, located at the vicinity of the tray, for holding the sheet conveyed through the second conveyance path, and forwarding the sheet into the third conveyance path; in which the sheet conveyance apparatus has a first mode that the sheet is forwarded into the third conveyance path by the nip rollers without being placed on the tray, and a second mode that the sheet is once placed on the tray and forwarded into the third conveyance path by the nip rollers.

5 Claims, 8 Drawing Sheets

RECORDING SHEET CONVEYANCE DEVICE FOR USE WITH AN IMAGE FORMING APPARATUS

BACKGROUND OF THE INVENTION

The present invention relates to a recording sheet conveyance apparatus used for an image forming apparatus such as an electrophotographic copier and laser printer, and more particularly relates to improvements in a recording sheet conveyance apparatus used for an image forming apparatus which can record an image on both sides of a recording sheet.

In an image recording apparatus such as an electrophotographic copier and laser printer, various techniques of an automatic two-sided recording apparatus by which not only one-sided recording but also two-sided recording can be carried out, have been proposed. In an automatic two-sided recording apparatus of the prior art, an image is formed on one side of a recording sheet in an image forming section, then the recording sheet is once stocked in an intermediate section, and after that, the recording sheet is conveyed again to the image forming section so that an image can be formed on the other side of the recording sheet. The aforementioned automatic recording sheet circulating apparatus is disclosed in Japanese Patent Application Open to Public Inspection Nos. 82247/1984, and 114227/1984.

In the case of a two-sided copy mode for a single recording sheet, after an image has been recorded on one side of the recording sheet, the recording sheet is discharged outside of the apparatus by a discharging roller and reversed, and then the recording sheet is supplied to the image forming section again so that an image is formed on the opposite side to the recorded side of the recording sheet.

In the case of a two-sided copy mode for a plurality of recording sheets, recording sheets on which an image has been transferred and fixed, are supplied again to the image forming section so that an image is formed on the opposite side.

The aforementioned conventional two-sided copier in which one sheet and a plurality of sheets of recording sheets are circulated and conveyed, is disclosed in Japanese Patent Application Open to Public inspection Nos. 111955/1983 and 183471/1987.

According to Japanese Patent Application Open to Public Inspection No. 111955/1983, in order to form an image on one side of a recording sheet, on the other side of which an image has already been formed, the recording sheet is guided to a sheet supply means and then conveyed to the recording section again without passing through a two-sided intermediate tray. Further, according to the aforementioned patent application, when the number of recording sheets is one, the recording sheet does not pass through the intermediate tray, and when the number of recording sheets is plural, the recording sheets are once stacked on the intermediate tray and then conveyed to the image forming section again.

In the case where the number of recording sheets is not more than the number of recording sheets which can be accommodated in the sheet conveyance passage in the apparatus, the recording sheets are conveyed without passing through the intermediate tray so as to improve the recording sheet conveyance efficiency.

In the same manner as Japanese Patent Application Open to Public Inspection No. 111955/1983, Japanese Patent Application Open to Public Inspection No. 183471/1987 discloses a copier which includes at least two sheet passages: one is the first sheet passage having no tray, in which a recording sheet on which an image has already been formed, is directly sent to the image forming section and the other is the second sheet passage in which a recording sheet is first stocked on a tray and then sent to the image forming section.

According to the aforementioned patent application, in the case where the number of copies to be made is not more than a predetermined value, the recording sheets are conveyed through the first passage in which they are directly returned to the copy station.

That is, selection can be made between the aforementioned first and second passages according to the number of recording sheets. Further, a predetermined number of recording sheets are conveyed through the aforementioned second passage to the recording section, and other recording sheets are conveyed through the aforementioned first passage.

In the case of the aforementioned conventional copier, there are provided two sheet conveyance passages: one is a sheet conveyance passage in which recording sheets are stacked on the intermediate tray and conveyed to the copy section; and the other is a sheet conveyance passage in which recording sheets are directly conveyed without being stacked on the intermediate tray. Therefore, the following problems are caused.

(1) The structure of the two-sided copier becomes complicated, so that the manufacturing cost is increased.

(2) Changing-over operations of the recording sheet conveyance passage are complicated. Accordingly, mechanical breakdowns are caused.

(3) It is difficult to adjust the timing of sheet conveyance since it is complicated.

(4) Reliability of the apparatus is lowered.

The present invention solves the aforementioned various problems. It is a primary object of the present invention to provide a recording sheet conveyance apparatus for an image forming apparatus characterized in that: in the case of a two-sided copy mode, sheet conveyance and intermediate stacking are smoothly conducted so that recording sheets can be correctly and stably conveyed. As a result, the reliability of recording sheet circulation can be improved, and the conveyance efficiency can be improved. Further, the copying speed can be increased.

SUMMARY OF THE INVENTION

In order to accomplish the aforementioned object, the present invention provides a recording sheet conveyance apparatus for an image forming apparatus by which two-sided recording can be performed in the following manner: an image is formed on one side of a recording sheet conveyed from a sheet supply section; the recording sheet is discharged and stacked on an intermediate tray of a recording sheet conveyance apparatus; and the stacked recording sheet is conveyed so that an image is formed on the other side of the recording sheet, wherein the recording sheet conveyance apparatus for an image forming apparatus comprises a reversible recording sheet supply and discharge means to discharge a recording sheet to the intermediate tray and to supply it from the tray in order to form an image on one side of a recording sheet, on the other side of which an image has already been formed, wherein a first mode is set in which the recording sheets are not stacked on the intermediate tray and one end of the recording sheet is held by a holding member so that the sheets can be supplied one by one, and further a second mode is set in which the recording sheets are stacked on the intermediate tray and then they are supplied, and wherein the recording sheet conveyance passages of the first and second modes are utilized in common.

The present invention is to provides a recording sheet conveyance apparatus for an image forming apparatus, comprising a reversible recording sheet supply and discharge means to discharge a recording sheet to the intermediate tray and to supply it from the tray in order to form an image on one side of a recording sheet, on the other side of which an image has already been formed, wherein a first mode is set in which the recording sheets are not stacked on the intermediate tray and one end of the recording sheet is held by a holding member so that the recording sheets can be supplied one by one, and further a second mode is set in which the recording sheets are stacked on the intermediate tray and then they are supplied, and the recording sheet conveyance apparatus for an image forming apparatus further comprises a control means including a constant A in a master table which has been previously determined in accordance with the size of the recording sheet and/or various conditions of the image forming apparatus, wherein the first and/or the second modes are/is selected, when a signal of the size of the recording sheet and/or the number of the processed recording sheets are/is compared with the aforementioned constant A, so that the recording sheet is conveyed.

DETAILED DESCRIPTION OF THE INVENTION

With reference to the attached drawings, an example of the present invention will be explained as follows.

Figure 1:
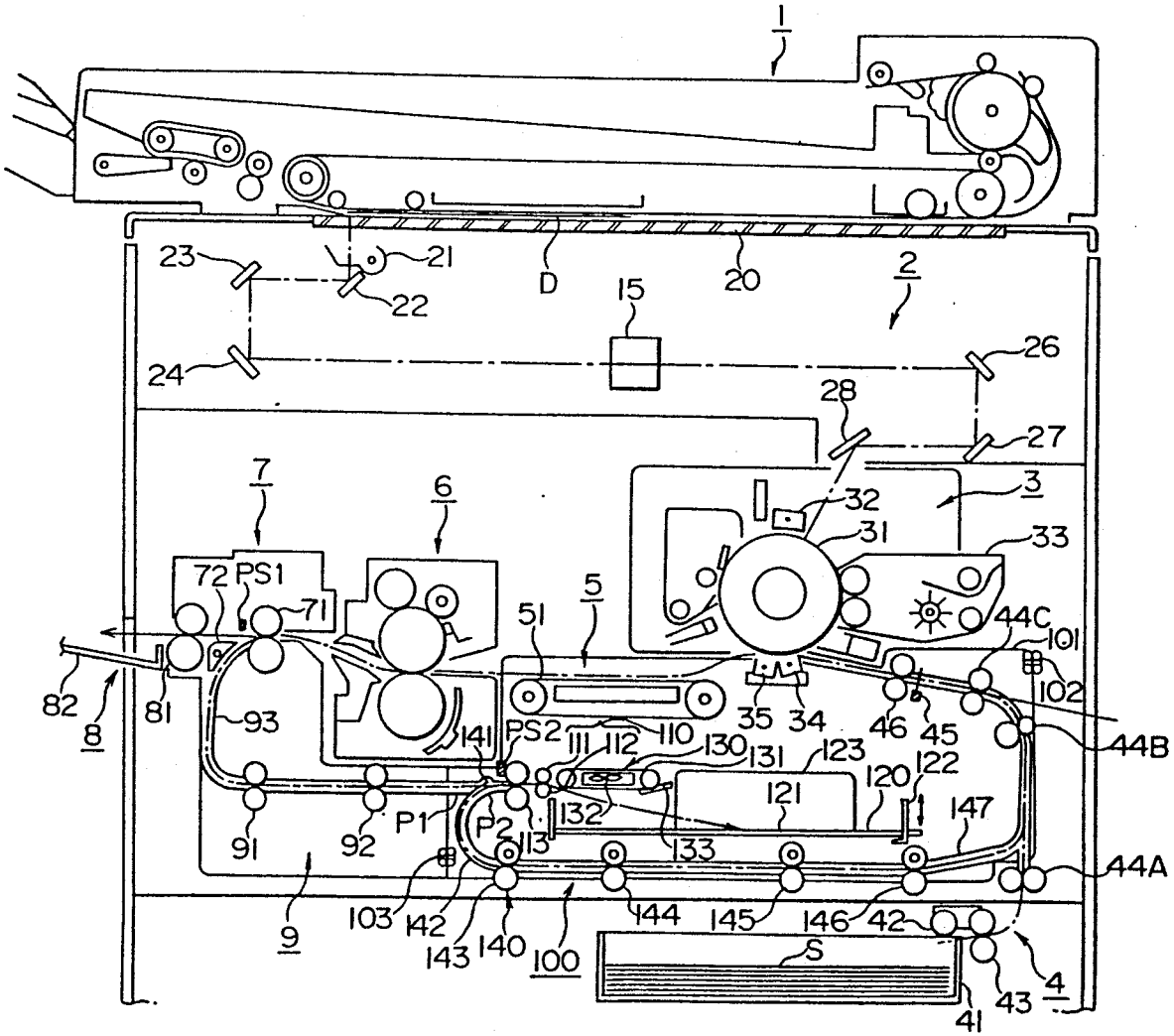
FIG. 1 is a schematic illustration showing the structure of a two-sided image recording apparatus provided with a two-sided recording sheet conveyance apparatus of the present invention.

FIG. 1 is a schematic illustration showing the structure of a two-sided image recording apparatus provided with a two-sided recording sheet conveyance apparatus (ADU) of the present invention.

In FIG. 1, numeral 1 is an automatic document feeder (RADF) having the function to reverse a two-sided document. Numeral 2 is a scanning exposure optical system. Numeral 3 is an image forming means provided around a photoreceptor drum 31. Numeral 4 is a transfer sheet supply means. Numeral 5 is a transfer sheet conveyance means. Numeral 6 is a fixing unit. Numeral 7 is a reversal sheet discharge changeover means. Numeral 8 is a sheet discharge means disposed outside of the apparatus. Numeral 9 is a first reversal conveyance means. Numeral 100 is a two-sided recording sheet conveyance means according to the present invention.

An image of document D placed on a platen 20 is irradiated with light emitted by an exposure lamp 21 of the scanning exposure optical system 1. The light is guided with mirrors 22, 23, 24 to a lens 25. Further, the light is guided with mirrors 26, 27, 28 to a photoreceptor drum 31, such that all the surface thereof is electrically charged by a charging unit 32, so that an electrostatic latent image is formed.

After a toner image on the photoreceptor drum 31 has been developed by the developing unit 33, it is transferred by a transfer unit 34 onto recording sheet S which has been conveyed though a sheet feed cassette 41, a pickup roller 42, a double feed preventing means 43 composed of a feed roller and a reverse roller, intermediate rollers 44A, 44B, 44C, a tip detector 45, and a registration roller. 46. Recording sheet S having a transferred toner image thereon is separated from the photoreceptor drum 31 by a separating unit 35, and conveyed to the fixing unit 6 through a conveyance belt 51 of the transfer sheet conveyance means 5 so that the transferred image is fixed. In the case of a one-sided copy mode, recording sheet S onto which a toner image has already been fixed, passes through a conveyance roller 71 and a changeover gate 72 of the reversal sheet discharge changeover means 7, and is discharged onto a sheet discharge tray 82 or a bin (not shown) of a sorter through a sheet discharge roller 81 of the sheet discharge means 8. In the aforementioned manner, a copy cycle is completed.

When a selection button is pressed to select between the one-sided copy mode and the two-sided copy mode, the reversal sheet discharge changeover means 7 changes over the passage of recording sheet S between an intermediate tray sheet supply unit 100 side and a discharge sheet tray 82 side.

In the case of the two-sided copy mode, recording sheet S onto which the first document image is transferred and fixed, is guided to conveyance rollers 91, 92 and a guide plate 93 of the first reversal conveyance means 9 by the changeover means 7, and then enters an intermediate tray sheet supply unit 100.

The intermediate tray sheet supply unit (recording sheet conveyance means) 100 is disposed on the conveyance downstream side of the first reversal conveyance means 9 and in a lower position than the copy sheet conveyance means 4. The intermediate tray sheet supply unit 100 includes a recording sheet introducing and discharging means 110, an intermediate tray 120, a sheet resupply means 130 to resupply recording sheet S to the intermediate tray 120, and a second reversal conveyance means 140 disposed in the lower position of the intermediate tray 120.

The recording sheet introducing and discharging means 110 includes a drive roller (an upper roller) 111 which is connected with a drive source so that it can be rotated normally and reversely, and a reverse roller (a lower roller) 112 which is brought into contact with the upper roller 111 with pressure so that it can be idly rotated, wherein the reverse roller 112 is provided with a one-way clutch or a torque limiter. Numeral 113 is a pair of conveyance rollers which can be rotated normally and reversely.

When recording sheet S is introduced into the intermediate tray sheet supply unit 100, the upper roller 111 and the conveyance rollers 113 are normally rotated, and the lower roller 112 comes into contact with the upper roller 111 with pressure so that the lower roller 112 is idly rotated clockwise. When recording sheet S is supplied from the intermediate tray sheet supply unit 100, the upper roller 111 is reversely rotated clockwise, however, the lower roller is not rotated idly but it is rotated reversely or stopped by the action of the torque limiter or the one-way clutch so that double feeding of sheet can be prevented. At this time, the conveyance rollers 113 are reversely rotated so that recording sheet S is conveyed to the side of passage P2.

The intermediate tray 120 and the tray body 121 are vertically lifted by a well-known lifting means which is not shown in the drawing. When recording sheet S is introduced onto the intermediate tray 120, it is lowered, when recording sheet S is supplied from the intermediate tray 120, it is lifted. When, the intermediate tray 120 is lifted, the height is detected by a height detecting member 133, and the intermediate tray 120 is stopped at a predetermined position while the uppermost recording sheet S is brought into contact with a conveyance belt 131 of a sheet resupply means 130 or a predetermined gap is formed between the uppermost recording sheet S and the conveyance belt 131. Numeral 122 is a sheet stopper which is moved when the size of recording sheet S is detected so that the leading edge of recording sheet S collides with the sheet stopper 122. Numeral 123 is a movable width regulating plate which aligns the width of recording sheet S.

The sheet resupply means 130 is disposed in a position close to the left end of the intermediate tray 120, and includes the conveyance belt 131, suction fan means 132 and sheet height detecting member 133.

The sheet resupply means 130 and suction fan 132 can be changed over between a state of sheet supply and that of sheet discharge. When a recording sheet is introduced into the intermediate tray, the fan is set to blow so that recording sheet S is pressurized downward and accommodated in the tray body 121 of the intermediate tray 120. When a recording sheet is supplied from the intermediate tray 120, the fan is set to suck so that the uppermost recording sheet S on the tray body 121 is sucked and conveyed in the direction of delivery. In the aforementioned manner, recording sheet S is supplied to the aforementioned recording sheet introducing and discharging means (switchback means) 110.

At a nip position of the recording sheet introducing and discharging means 110 where the leading edge of recording sheet S is held, only the uppermost recording sheet is sent out in the direction of an arrow mark by the action of the upper roller 111 which is rotated and the reverse roller 112 which is rotated through the torque limiter in the direction reverse to the recording sheet conveyance direction so that double feeding can be prevented.

A flexible film-shaped changeover member 141 is provided on the conveyance downstream side of the switchback means 110 at a branch position of a guide plate disposed downstream of the conveyance roller 92. Due to the changeover member 141, it is possible to guide recording sheet S which has passed through the conveyance roller 92, to the switchback means 110 side through the first passage P1. Further, due to the changeover member 141, it is possible to correctly guide the recording sheet which is conveyed out from the switchback means 110 and supplied to the second passage P2 so that the recording sheet can not be conveyed backward to the first passage P1.

The second passage P2 is formed into a U-shaped reversal guide plate 142. Downstream of the guide plate 142, under the tray body 121, there is provided a second reversal conveyance means 140 which includes a plurality of rotatable conveyance rollers 143, 144, 145, 146 and a delivery guide plate 147. Each of the conveyance rollers 143, 144, 145, 146 includes a pair of drive roller and idle roller. The distance between the conveyance rollers is smaller than the minimum length of recording sheets. The conveyance means 140 may be composed of a driven conveyance belt and idle rollers.

Recording sheet S sent from the sheet resupply means 130 is conveyed through a gap formed between the reversal guide plates 142 and conveyed toward the right side delivery guide plate 147 while the recording sheet is being held by the conveyance rollers 143, 144, 145, 146.

The conveyed recording sheet S passes through the intermediate rollers 44B, 44C and the registration roller 46. Then, an image is formed on the reverse side of recording sheet S. After that, recording sheet S passes through the reversal sheet discharge changeover means 7, and is discharged and stacked on a discharge sheet tray 82. Then, subsequent recording sheets on the tray body 121 are successively conveyed out, and pass through the aforementioned conveyance passage, and are then stacked on the discharge sheet tray 82.

The case in which a two-sided document is copied on both sides of a plurality of recording sheets, is described above. Multi-recording is conducted on the same surface of recording sheet S in the following manner: recording sheet S conveyed out from the conveyance roller 71, is once discharged onto the discharge roller 81 side at the changeover gate 72; while the trailing edge of recording sheet S is held by the discharge roller 81, recording sheet S is switched back so that it is guided to the guide plate 93 and reversed; and recording sheet S passes through the same conveyance passage as described above, and is supplied again so as to receive an image.

The aforementioned intermediate tray sheet supply unit 100 is integrated into one unit. Slide rails 102, 103 are provided on both sides of the unit body 101, so that the unit can be pulled out from the apparatus body. In the case where recording sheet S is jammed in the sheet resupply means 130 or the reversal conveyance means 140, the aforementioned intermediate tray sheet supply unit 100 which is integrated into one unit, is slid forward along the slide rails 102, 103 so that inspection and adjustment can be easily performed and sheet feeding can be resumed.

Next, the copy mode will be explained in detail.

Figure 2:
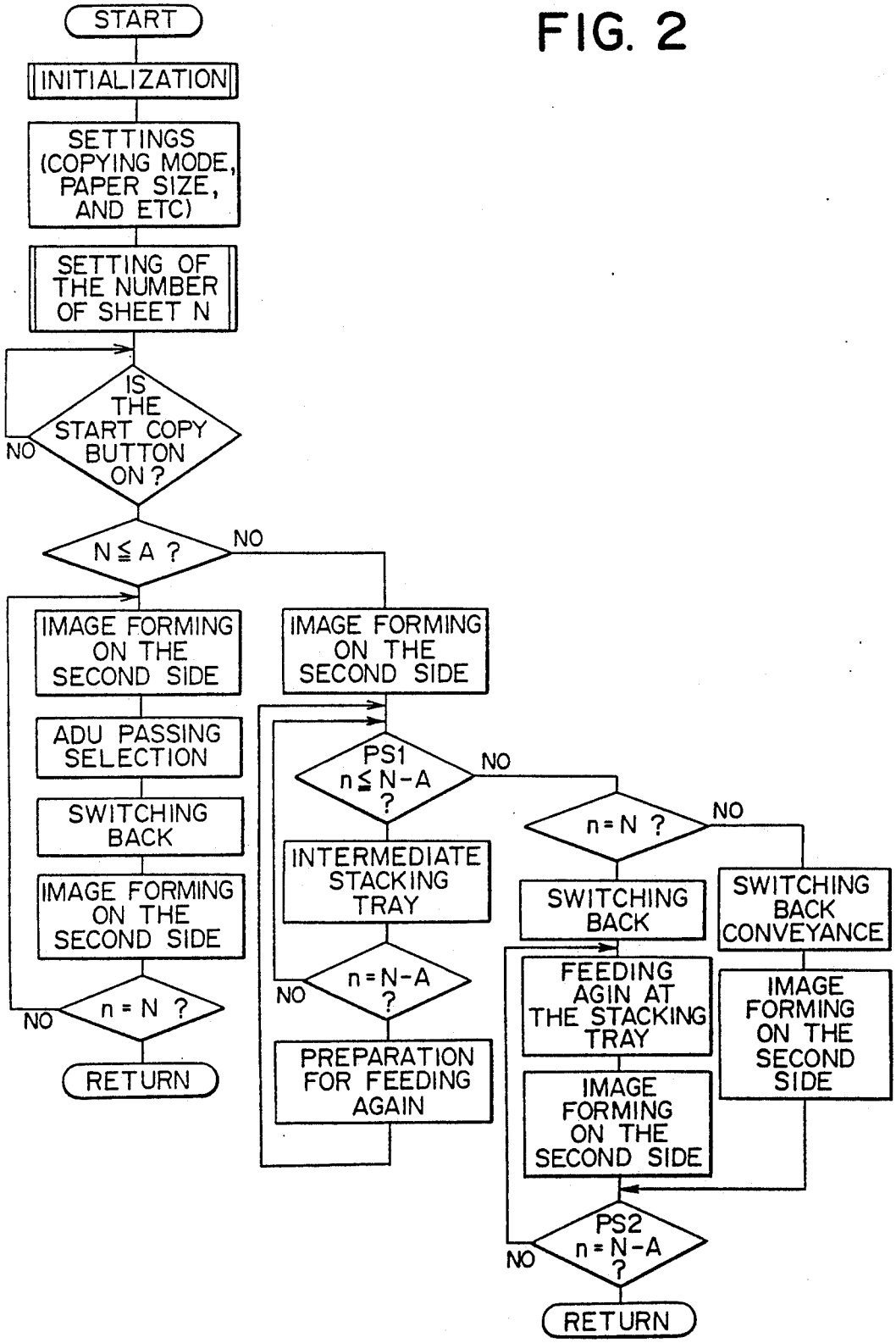
FIG. 2 is a flow chart showing the operation of the recording sheet conveyance apparatus for an image forming apparatus of the present invention.
Figure 3:
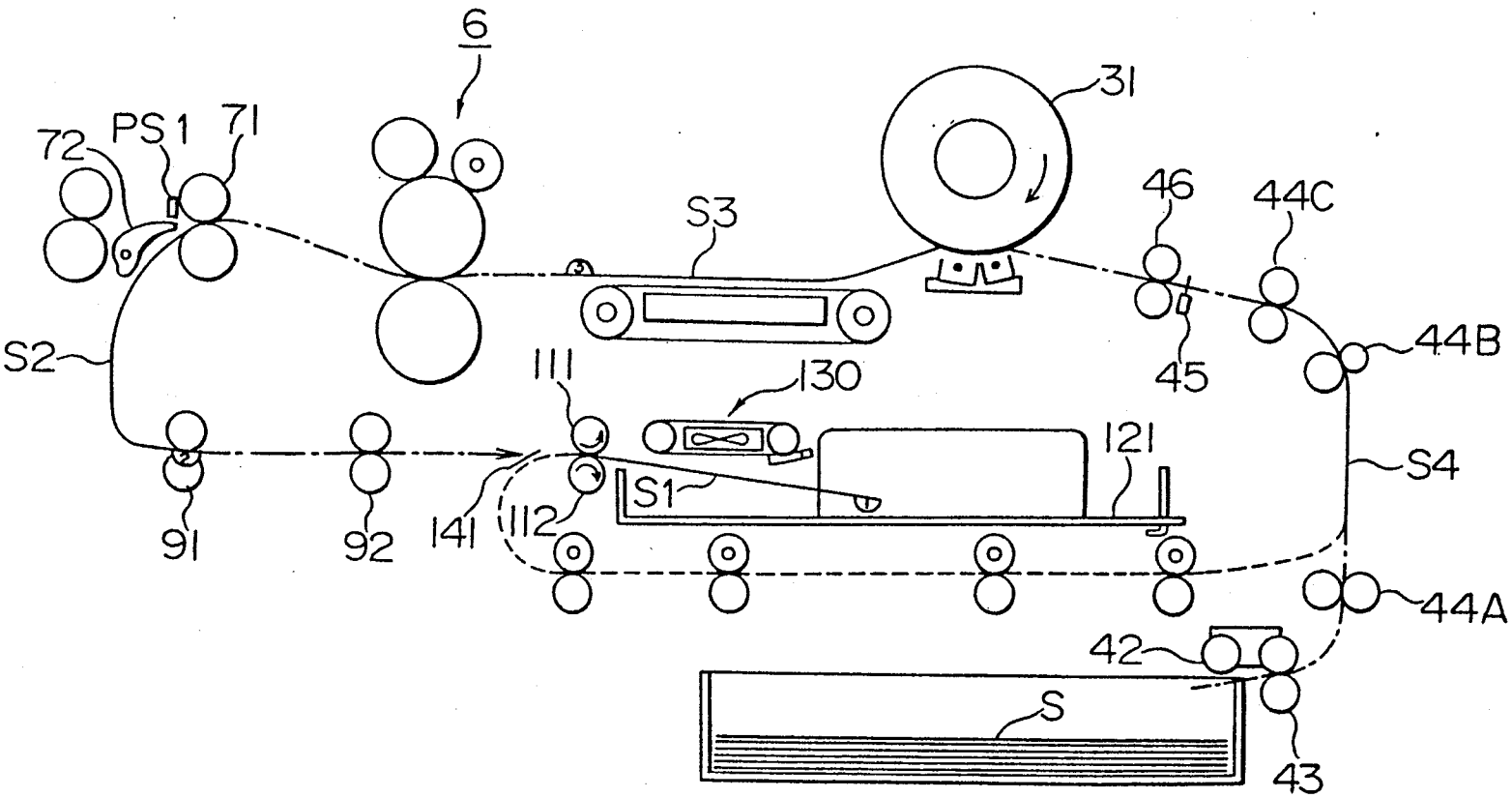
FIG. 3 is a schematic illustration showing a recording sheet conveyance passage from the recording sheet supply section of the first mode to the intermediate tray recording sheet supply unit.
Figure 4:
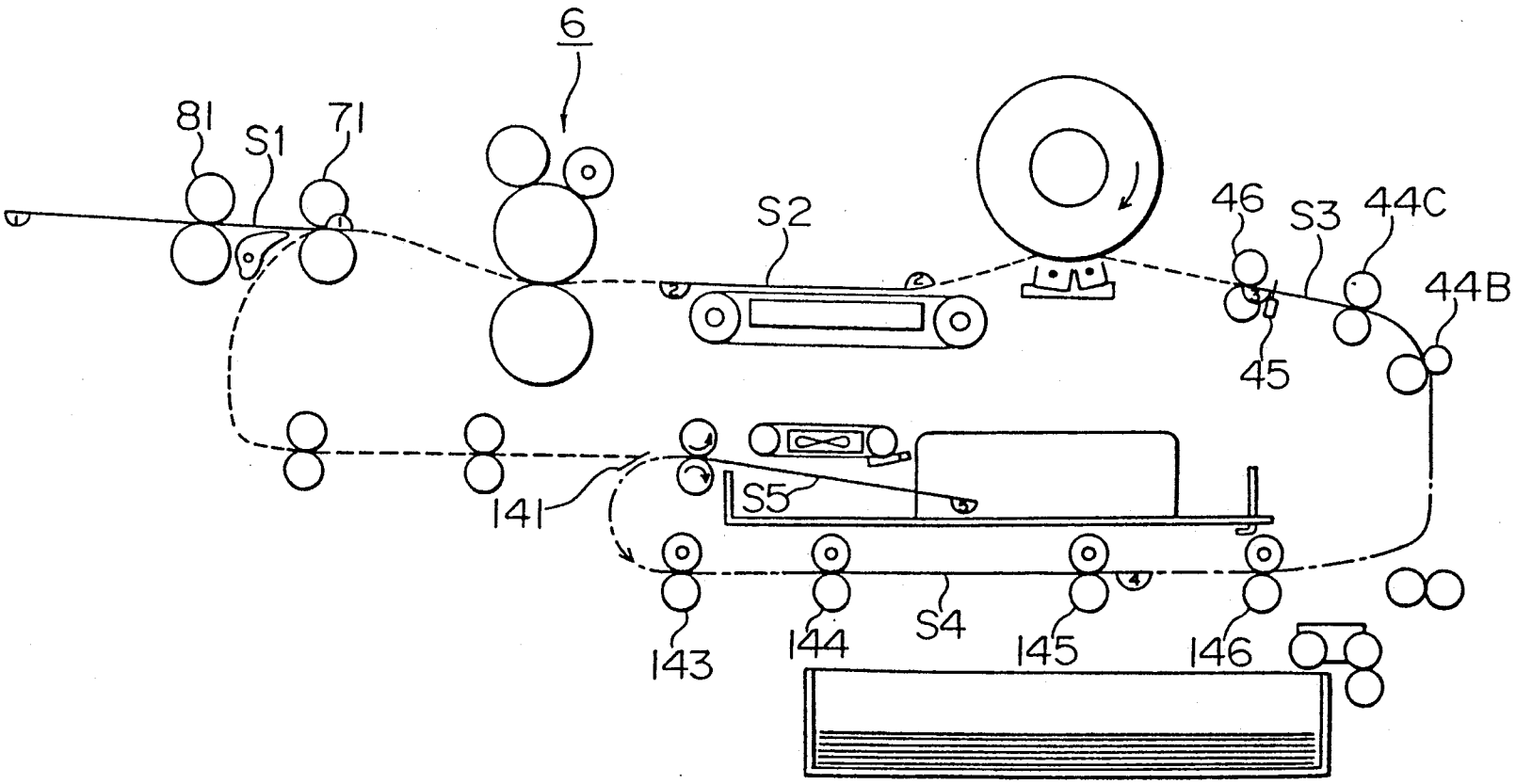
FIG. 4 is a schematic illustration showing a recording sheet conveyance passage of the first mode from the intermediate tray recording sheet supply unit to the discharge of the recording sheet which has been supplied again.
Figure 5:
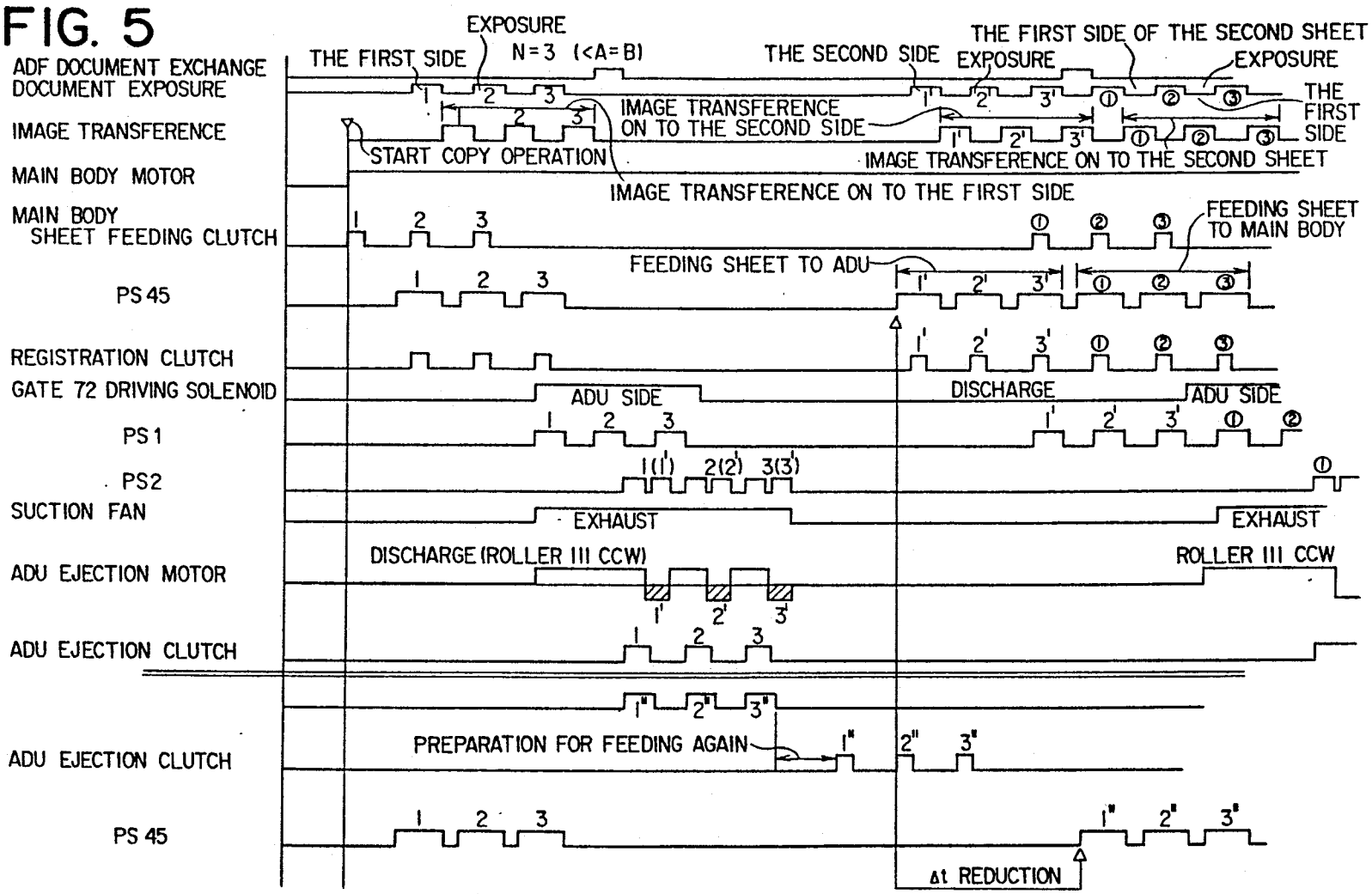
FIG. 5 is a timing chart showing the progress of conveyance conducted in the first mode.

FIG. 2 is a flow chart showing an operation of the recording sheet conveyance apparatus for an image forming apparatus of the present invention. FIG. 3 is a schematic illustration showing a model of a recording sheet S conveyance passage from sheet supply to the intermediate tray sheet supply unit in the first mode of the recording sheet conveyance apparatus according to the present invention. FIG. 4 is a schematic illustration showing a model of the recording sheet conveyance passage of the first mode in which recording sheet S resupplied from the intermediate tray sheet supply unit is discharged outside of the apparatus after image formation. FIG. 5 is a timing chart of this conveyance process.

A recording sheet conveyance process of the first mode will be explained as follows.

(1) A copy mode of the ADF is set. (one-sided document → two-sided copy, two-sided document → two-sided copy)

(2) The size of a recording sheet is inputted. (A3 size, A4 size and the like) Alternatively, the size of a recording sheet may be automatically selected.

(3) A fixing condition (thick sheet, thin sheet and the like) and a copy magnification are inputted. Alternatively, they may be automatically selected.

From the aforementioned conditions (1), (2) and (3), constant A can be determined in accordance with a predetermined table. In this case, constant A is tabulated in the following manner: constant A is not more than the number of sheets which can be disposed among the separator 35, conveyance means 5, reversal sheet discharge changeover means 7, guide plate 93, introducing and discharging means 110, second reversal means 140, delivery port guide plate 147, and registration roller 46 while an interval between recording sheets determined in each mode is maintained; and constant A is close to the aforementioned number. Table 1 shows an example of constant A.

TABLE 1

| | 1.0 Magnification | 1.44 Magnification |
|---|---|---|
| Size B5 | 9 | 6 |
| Size A4 | 8 | 5 |
| Size B4 | 5 | 3 |
| Size A3 | 4 | 2 |

(5) Number N of processed recording sheets is inputted with ten keys.

Number N of processed recording sheets and constant A are compared.

When $N \leqq A$, recording sheet conveyance is conducted in the following conveyance process of the first mode.

(6) A copy start button is pressed.

(7) From a stack of blank recording sheets accommodated in the sheet supply cassette 41, recording sheet S is supplied by the pick-up roller 42 and the double feed preventing means 43 at regular intervals one by one. Recording sheet S passes through the intermediate rollers 44A, 44b, 44C, and is temporarily stopped by the registration roller 46 in accordance with a signal sent from the leading edge detector 45.

(8) Recording sheet S is supplied again synchronously with image formation conducted on the photoreceptor drum 31, and an image is transferred onto the first side of recording sheet S, and then the image is fixed by the fixing unit 6.

(9) The changeover gate 72 is changed over downward with regard to the conveyance passage, and recording sheet S, on the first side of which an image has already been formed, is sent to the guide plate 93 of the first reversal conveyance means 9.

(10) When a sensor PSI detects that the trailing edge of recording sheet S has passed through the nip position of the fixing unit 6, the conveyance roller 71 and the conveyance roller of the first reversal conveyance means 9 are changed over to a high speed operation so that the conveyance speed is increased.

(11) When the drive roller 111 of the switchback means 110 is driven counterclockwise so that the reverse roller 112 coming into contact with the drive roller 111 is idly rotated, recording sheet S is sent to the tray 121.

(12) When the trailing edge of recording sheet S is detected by sensor PS2 disposed upstream immediately before the nip position of the switchback means 110, the drive roller 111 is changed over to reverse rotation under the condition that the trailing edge of recording sheet S is nipped. At this time, the reverse roller (the lower roller) 112 is stopped by the action of the one-way clutch or torque limiter provided in the roller. However, recording sheet S is conveyed by the rotation of the drive roller 111.

(13) The trailing edge of recording sheet S which has been resupplied (that is, the leading edge in the resupplying operation), is switched back and conveyed out along the reversal guide plate 142 so that it is conveyed separately from the original passage.

(14) Recording sheet S passes through the reversal guide plate 142, and is conveyed by the conveyance rollers 143, 144, 145, 146 being nipped. Then, recording sheet S passes through a U-turn passage, and temporarily stops at the registration roller 46 which is controlled by a signal sent from the leading edge detector 45, so that recording sheet S is nipped.

(15) Concurrently with the completion of document exposure corresponding to the last recording sheet sent from the sheet supply cassette 41, the side of the document to be exposed next is set due to the two-sided document automatic reversal function of the automatic document feeder 1.

(16) After the first side of the last recording sheet sent out from the cassette 41 has been copied, the next document is set, and in accordance with the document setting operation, the registration roller 46 is operated to supply a recording sheet synchronously with the image formation conducted on the photoreceptor drum 31, so that an image is transferred onto the second side of recording sheet S, and then the transferred image is fixed by the fixing unit 6.

(17) The changeover gate 72 changes over the conveyance passage upward, and recording sheet S is discharged onto the discharge sheet tray 82 arranged outside of the apparatus, by the sheet discharge roller 81.

Next, when $N \geqq A$ (for example, number of processed sheets $N=8$, and constant $A=8$), processing is carried out in accordance with the following second mode.

Figure 6:
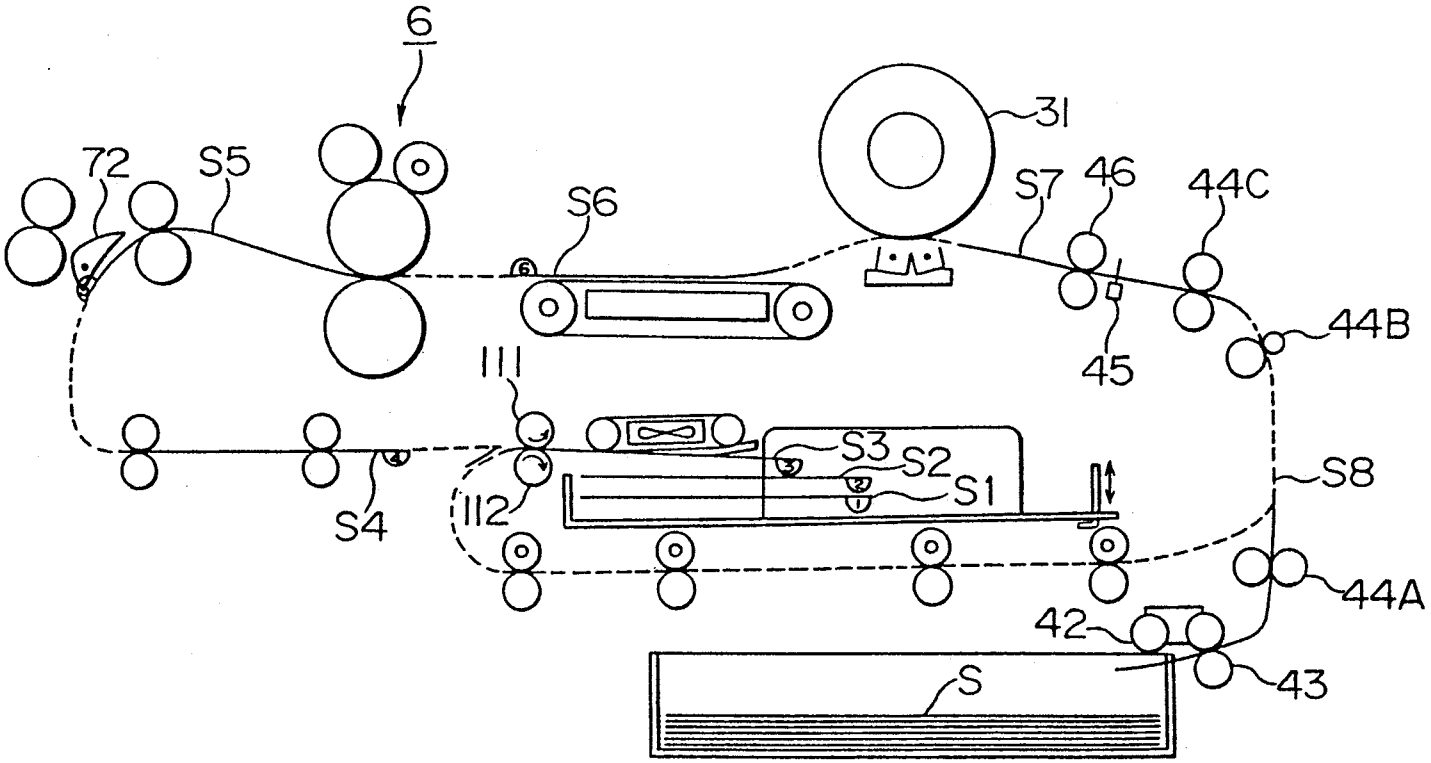
FIG. 6 is a schematic illustration showing the progress of conveyance from the recording sheet supply section to the intermediate stack section in the second mode.
Figure 7:
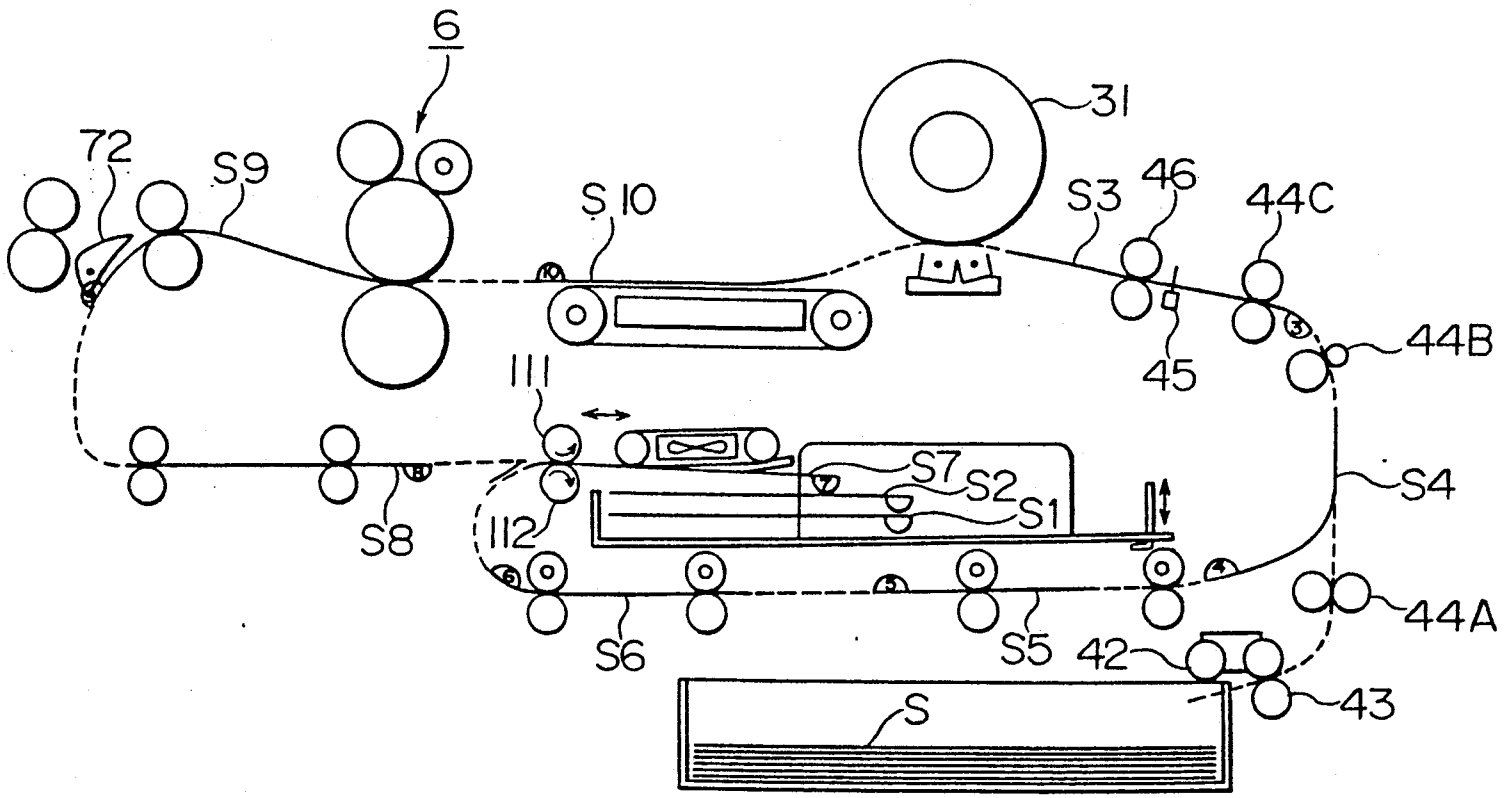
FIG. 7 is a schematic illustration showing the progress from the intermediate stack section to the discharge of a recording sheet after the recording sheet has been supplied again and an image has been formed on the recording sheet again.
Figure 8:
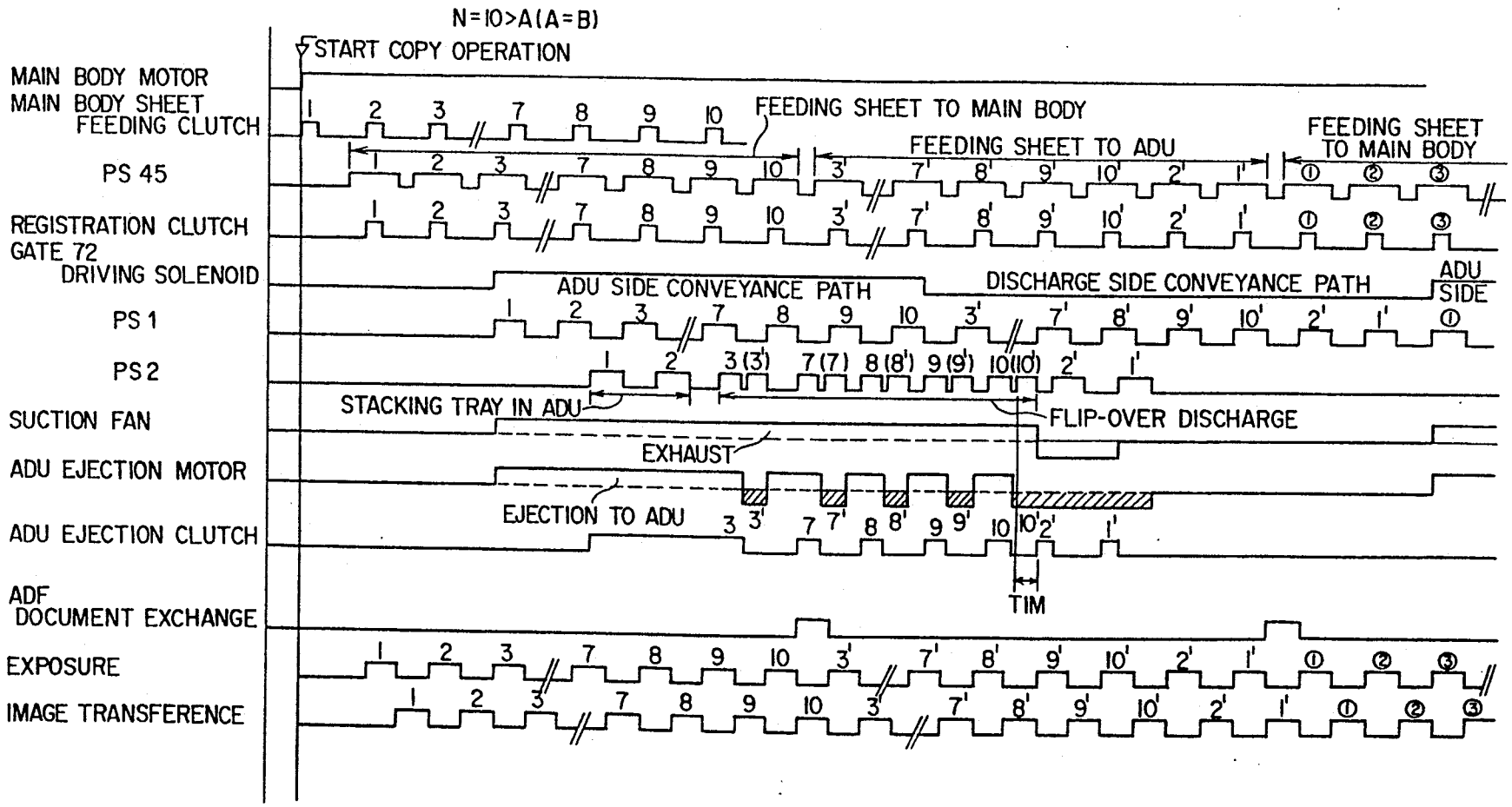
FIG. 8 is a timing chart of recording sheet conveyance of the second mode.

FIG. 6 is a schematic illustration showing the process from sheet supply to the intermediate stacking section in the case of the second mode. FIG. 7 is a schematic illustration showing the process from the intermediate stacking section to sheet discharge performed after image formation. FIG. 8 is a timing chart of the process of recording sheet conveyance performed in the second mode.

(a) An image is formed on the first side of recording sheet S which has been sent out from the sheet supply cassette 41. Then, recording sheet S passes through the first reversal conveyance means 9 and the changeover means 141. When the switchback means 110 is rotated, recording sheet S is discharged and accommodated onto the tray body 121 of the intermediate tray sheet supply unit 100.

At this time, the tray body 121 is located in a lowered position, and the width regulating plate 123 is oscillated at each recording sheet discharged onto the tray body 121 so that the width of recording sheet S is aligned.

The suction means 132 is set to blow so that recording sheet S is pushed by wind pressure to stabilize the conveyance of recording sheet S. Then, recording sheet S collides with the stopper 122 so as to be positioned. (At this time, the sheet stopper 122 may be oscillated to align the recording sheet in the longitudinal direction.)

(b) The number of copied recording sheets S is detected by sensor PS1 and counted. The aforementioned operation is repeated until n becomes $n=N-A$. (For example, in the case where $N=10$ and $A=8$, the first and second recording sheets S are stacked on the tray body 121 when $n=2$.) Then, the recording sheets S are aligned so as to be resupplied.

(c) When it is judged that $n=N-A$, the operation is performed as follows. After an image has been formed on the first side, recording sheets S after $n>N-A$ (for example, recording sheets S after the third), in the same manner as the aforementioned first mode, pass through the first reversal conveyance means 9 and the changeover means 141. Then, recording sheets S are conveyed to the tray body 121 by the switchback means 110, and the trailing edge of the sheet is held at the nip position of the switchback means 110 so that the sheet is stopped temporarily.

That is, recording sheet S is maintained in a condition that the trailing edge is nipped, so that recording sheet S does not drop onto the tray body 121.

(d) Concurrently when document exposure corresponding to the N-th recording sheet has been completed, the automatic document feeder 1 sets a document to be copied onto the second side of recording sheet S, so that the process is ready to receive recording sheet S which is switched back.

(e) When the switchback means 110 is reversely driven, recording sheet S is resupplied and switched back. Then, it passes through the second reversal conveyance means 140. After that, image formation is conducted on the second side of recording sheet S by the image forming means 3.

(f) In the same manner as described above, the following recording sheets S (for example, after the fourth sheet to $N=10$-th sheet), are subjected to the nipping and switching-back operation in the intermediate tray sheet supply unit 100, and sequentially copied on both sides, and then discharged outside of the apparatus. In the aforementioned manner, the third to the tenth recording sheets S are not accommodated in the tray body 121, but they are switched back so that images can be copied on both sides.

(g) When a predetermined period of time has passed after the N-th recording sheet was switched back, the first recording sheet S2 accommodated in the tray body 121 (for example, the second recording sheet) is resupplied.

(h) That is, when the tray body 121 is lifted, the height of the uppermost recording sheet S is detected by the detection member 133. Then, the tray body 121 is stopped at a predetermined position. Next, due to the rotation of the conveyance belt 131 and suction of the suction fan means 132, the uppermost recording sheet S (for example, the second recording sheet) is pulled out. The recording sheet pulled out is conveyed out to the second reversal conveyance means 140 when the drive roller 111 of the switchback means 110 is reversely rotated. After an image has been formed on the second side of the recording sheet by the image forming means 3, the recording sheet is discharged outside of the apparatus.

(i) Also, the first recording sheet S1 is successively resupplied, and an image is formed on the second side, and then it is discharged outside of the apparatus. In this manner, all recording sheets S are copied on both sides. (For example, $n=N=10$)

In order to reduce the sheet resupply interval, a lifting operation of the tray body 121 may be started beforehand. When a document is replaced by the automatic document feeder (ADF) 1 while image formation is not conducted on recording sheet S, or when a two-sided document is reversed while image formation is not conducted on recording sheet S, waiting time can be eliminated and two-sided copying operations can be effectively carried out.

A case in which two-sided copying operations are carried out, is explained above. However, the invention can be applied to a case in which multi-recording is conducted on the same side of a recording sheet. A conveyance passage of a recording sheet, in which the recording sheet is copied on one side, conveyed to the intermediate tray and then copied on the other side, is not limited to the aforementioned conveyance method which is referred to as "Reverse B-shaped Conveyance". For example, the aforementioned conveyance passage can be adopted to a conveyance method disclosed in U.S. Pat. No. 4,673,279 and any other methods.

As explained before, in the present invention, a passage having an intermediate stack section and a second passage having no intermediate stack section are incorporated into one unit. Consequently, the apparatus can be simplified, and manufacturing costs can be reduced, and further the apparatus can be made compact. Furthermore, there is a low possibility of mechanical breakdown, and maintenance can be easily carried out. As a result, reliability is improved.

According to the present invention, recording sheets which have passed through the image forming section, are processed in the following manner: only when the number of recording sheets exceeds a predetermined number determined by the copy mode and the sheet size (shown in Table 1), are they accommodated in the intermediate tray; when the number of recording sheets is within the predetermined number, they are not accommodated in the intermediate tray; the recording sheets introduced into the intermediate tray sheet supply unit, are immediately switched back each time so that an image can be formed on both sides, or multi-recording can be conducted. Therefore, image recording and processing time can be reduced.

What is claimed is:

1. A sheet conveyance apparatus for conveying a sheet so that an image of a document is duplicated on both sides of said sheet by an image forming apparatus, comprising:

a first conveyance path for conveying said sheet to an image forming section of said image forming apparatus;

a second conveyance path for conveying said sheet from said image forming section to a tray means for holding said sheet;

a third conveyance path for conveying said sheet from said tray means to said image forming section; and holding and forwarding means, positioned in a vicinity of said tray means, for holding said sheet conveyed through said second conveyance path, and for then forwarding said sheet into said third conveyance path;

wherein in a first mode of operation of said sheet conveyance apparatus, said sheet is forwarded after being held by said holding and forwarding means, without said sheet being placed on said tray means, into said third conveyance path by said holding and forwarding means, and in a second mode of operation of said sheet conveyance apparatus, said sheet is first placed on said tray means and then forwarded into said third conveyance path by said holding and forwarding means.

2. A sheet conveyance apparatus for conveying a sheet so that an image of a document is duplicated on both sides of said sheet by an image forming apparatus, comprising:

a first conveyance path for conveying said sheet to an image forming section of said image forming apparatus;

a second conveyance path for conveying said sheet from said image forming section to a tray means for holding said sheet;

a third conveyance path for conveying said sheet from said tray means to said image forming section;

holding and forwarding means, positioned in a vicinity of said tray means, for holding said sheet conveyed through said second conveyance path, and for then forwarding said sheet into said third conveyance path;

wherein:

in a first mode of operation of said sheet conveyance apparatus, said sheet is forwarded after being held by said holding and forwarding means, without said sheet being placed on said tray means, into said third conveyance path by said holding and forwarding means;

in a second mode of operation of said sheet conveyance apparatus, said sheet is first placed on said tray means and then forwarded into said third conveyance path by said holding and forwarding means;

in a third mode of operation of said sheet conveyance apparatus, at least two documents respectively having an image formed on one side thereof, are respectively duplicated on each side of said sheet; and in a fourth mode of operation of said sheet conveyance apparatus, a two-sided document is duplicated on both sides of said sheet;

fixing condition selection means for inputting into the sheet conveyance apparatus, at least one of a sheet thickness data, a sheet size data, a plurality of data indicating a magnification of the image to be provided on said sheet and a mode of operation data for indicating a mode of operation of said sheet conveyance apparatus; and selecting means for selecting one of the first, second, third and fourth modes of operation of said sheet conveyance apparatus based on the selected at least one of the sheet size data, the sheet thickness data, the plurality of data indicating a magnification of said image to be provided on said sheet and the mode of operation data.

3. The sheet conveyance apparatus of claim 2 wherein said selecting means includes:

determining means for determining a number of sheets which are simultaneously positionable in at least one of said second conveyance path and said third conveyance path, based on said at least one of said sheet thickness data, said sheet size data, said plurality of data indicating a magnification of said image to be provided on said sheet and said mode of operation data.

4. The sheet conveyance apparatus of claim 3, further comprising:

input means for inputting a duplication number that indicates how many sheets on which said image of the document is to be duplicated continuously; and controlling means for controlling said selecting means to select the first mode of operation when said number of sheets determined by said determining means is not more than said duplication number of sheets.

5. The sheet conveyance apparatus of claim 3, wherein said determining means determines said number of sheets based on said sheet size data and said data indicating a magnification of said image to be provided on said sheet.

* * * * *